United States Patent [19]

Noguchi et al.

[11] 4,169,767

[45] Oct. 2, 1979

[54] PROCESS FOR CALCINING COKE

[75] Inventors: Kosaku Noguchi, Tokyo; Nobuyuki Komi, Mitaka, both of Japan

[73] Assignee: Koa Oil Company, Limited, Tokyo, Japan

[21] Appl. No.: 890,707

[22] Filed: Mar. 24, 1978

[30] Foreign Application Priority Data

Jun. 27, 1977 [JP] Japan ..... 52-76267

[51] Int. Cl.[2] ..... C10B 57/00; C01B 31/02

[52] U.S. Cl. ..... 201/27; 201/15; 201/33; 202/131; 202/216; 423/448

[58] Field of Search ..... 201/15, 27, 32, 33; 264/29.1-29.7; 423/448, 460, 461; 208/50, 53; 75/42; 202/100, 131, 136, 216; 432/13, 14, 15, 17, 106 (U.S. Only)

[56] References Cited

U.S. PATENT DOCUMENTS

| | | | |
|---|---|---|---|
| 1,556,194 | 10/1925 | Bacon | 202/131 |
| 1,564,730 | 12/1925 | Walden | 201/25 |
| 2,259,702 | 10/1941 | Lindhard | 432/58 |
| 2,400,935 | 5/1946 | Kent | 202/131 |
| 2,813,822 | 11/1957 | Collier | 202/100 |
| 3,271,268 | 9/1966 | Allred | 201/20 |
| 3,612,497 | 10/1971 | Allred | 201/27 |
| 3,700,564 | 10/1972 | Willibald et al. | 264/29.7 |
| 3,759,795 | 9/1973 | Oliver | 201/27 X |
| 3,823,073 | 7/1974 | Minkkeinen | 423/461 X |
| 3,950,503 | 4/1976 | Spars | 423/461 X |
| 3,966,560 | 6/1976 | Farago et al. | 201/27 |
| 4,022,569 | 5/1977 | Farago et al. | 432/14 |

*Primary Examiner*—Morris O. Wolk
*Assistant Examiner*—Roger F. Phillips
*Attorney, Agent, or Firm*—Wenderoth, Lind & Ponack

[57] ABSTRACT

A process for calcining green coke containing water and combustible volatile matter and obtained by a delayed coking process in three or more stages of heating furnaces which are connected in series, and the control of the temperature and the adjustment of the atmosphere in the respective furnaces can be independently carried out, which process comprises carrying out, in respective furnaces in the indicated order, the steps of:

(a) evaporating the water contained in the green coke, and drying and pre-heating the coke;

(b) distilling off and burning the volatile matter from the dried coke; and (c) heating and calcining the coke from the step (b).

Because each furnace can be controlled independently from the other furnaces in the above described process, it is possible to produce high-grade coke without process difficulties such as the loss of the coke by combustion and the formation of coke ring.

7 Claims, 2 Drawing Figures

PROCESS FOR CALCINING COKE

BACKGROUND OF THE INVENTION

The present invention relates to a process for calcining green coke obtained from a delayed coking process. More specifically, the present invention contemplates producing high-grade coke efficiently by carrying out unit process stages for calcining green coke in respectively separate heating furnaces.

Preparation of green coke from heavy oils of petroleum or coal origin such as residue oils of catalytic cracking and thermal cracking, straight run residue oils and tar of thermal cracking, coal tar pitch or mixtures thereof by a delayed coking process which comprises heat treatment at a temperature of 400° to 550° C. for 60 minutes to 50 hours is known. The green coke produced by this process still contains a significant quantity of moisture and volatile matter. Accordingly, there is also known a process for calcining the produced green coke in order to remove the water content and volatile matter from the green coke and to densify it, thereby producing a carbon material having a high density and a low coefficient of thermal expansion which is suitable for use as an electrode material for steel-making, aluminum smelting or the like or a carbon material for other shaped articles.

Calcining of such green coke is carried out in heating furnaces such as a rotary kiln, a rotary hearth, and a shaft kiln. That is, the raw material green coke introduced into the furnace through its inlet is dried, heated and calcined by heat of combustion resulting from the combustion of fuels, the volatile matter produced from the coke and part of the calcined coke during the time the coke is transferred to its outlet and the calcined coke is then removed from the furnace. In addition, it is well known that the calcining temperature, the rate of heating, and the furnace atmosphere in a series of calcining stages have an influence on the quality of the calcined coke. Accordingly, various types of improved processes for calcining green coke have been proposed.

One of these processes comprises pre-drying green coke in a separate apparatus by utilizing the heat of a hot gas leaving a rotary kiln before the coke is introduced into the rotary kiln (as disclosed in Japanese Patent Laid-open Publication No. 33201/1975). Another process comprises calcining green coke in a rotary kiln by supplying air through more than one opening at an intermediate part of the kiln in order to ensure complete vaporization and combustion of the volatile matter contained in the green coke which have a great influence on the quality of the calcined coke (as disclosed in Japanese Patent Laid-open Publication No. 16031/1975).

Of the above described improved processes, the former is said to be characteristic in that drying of green coke can be carried out at a low cost of operation and with good control of the process operation. However, it cannot be said that controlling of the drying process only is a substantial improvement in a calcining process for obtaining high-grade coke.

On the other hand, the latter is said to be advantageous in that the combustion of the volatile matter contained in green coke is promoted, in that the heat of combustion is utilized, and in that useless combustion of completely calcined coke is avoided. However, this process entails the following problems. A rapid temperature rise due to the combustion of the volatile matter which occurs at an air blowing place has a great influence on the quality of the resulting coke, and it is difficult to independently control the optimal temperature of the final stage of the calcining which has a great influence on the quality of the resulting coke because the calcining temperature of the final stage is greatly affected by the combustion control of the volatile matter.

Accordingly, it can be said that the above described known processes are still not fully satisfactory as processes for calcining green coke. According to the knowledge of the inventors, it is considered that the difficulties accompanying the known processes are attributable to the fact that control factors are too few as compared with the number of the unit stages included in the calcination of green coke. That is, as stated above, the calcination of green coke involves three unit stages: water removing and drying stage, volatile matter removing and combusting stage, and final calcining stage. It is preferable that these unit stages be controlled independently from each other. The reasons for this are as follows.

(1) Green coke ordinarily contains 7 to 10% by weight of water and 6 to 10% by weight of volatile matter and in the calcining process, the water is evaporated at about 100° C. and the volatile matter begins to evaporate at an increased temperature of the order of 450° C. That is, the respective evaporation temperatures are different from each other and the evaporated volatile matter burns and serves as a source of heat. Therefore, in order to ensure the stabilization of temperature distribution throughout the total calcining process when a raw material having different contents of water and volatile matter is used, the water removing stage and the volatile matter removing and burning stage are preferably controlled independently from each other.

(2) Green coke ordinarily contains a volatile matter content of 6 to 10% by weight or as high as 20% by weight depending upon the operation conditions of a delayed coker (the volatile matter substances are these which are defined according JIS M 8812). When this volatile matter is heated to a temperature of 450° to 600° C. in a heating furnace, it is evaporated, and a part thereof is melted. The melt functions as a binder forming carbonaceous adhesive matter such as ring-shaped adhesive matter (coke ring) in a rotary kiln, thereby preventing a normal flow of coke. However, if an adequate oxidizing atmosphere is maintained in the furnace, fusible volatile matter is rendered infusible in the course of temperature rise, whereby the formation of such carbonaceous materials can be prevented.

Such maintenance of an adequate oxidizing atmosphere in the volatile matter removing stage not only makes the volatile matters infusible but also improves the combustion condition thereof, which in turn affords an efficient recovery of heat. However, in the prior system wherein the volatile matter removal and the final calcining are carried out in one furnace, maintaining of a sufficiently oxidizing atmosphere so as to effectively carry out the removal and combustion of the volatile matter in the volatile matter removal stage leads to the combustion of the product coke in the final calcining stage, and this is therefore unfavorable. Thus, according to the prior system, the loss of coke is as high as about 10% by weight.

(3) Since the conditions of the final calcining stage particularly have an influence on the property of the product coke, it is preferable that the final calcining stage be controllable independently of the preceding water removing stage and volatile matter removing and burning stage.

SUMMARY OF THE INVENTION

On the basis of the above considerations, the present invention aims at providing an improved process for calcining green coke wherein, by adopting a system in which the respective stages of the calcining of green coke can be independently controlled, high-graded coke is obtained in a high yield while an effective utilization of heat is maintained, and such problems as the adhesion of carbonaceous materials are eliminated.

Accordingly, the process for calcining green coke according to the present invention is a process for calcining green coke obtained by a delayed coking process in heating furnaces of three or more stages connected in series, in which the control of temperature and the adjustment of atmosphere in the respective furnaces can be independently carried out, which process comprises carrying out the following steps in the respective furnaces in the indicated order:

(a) evaporating the water contained in the green coke, and drying and preheating the coke;
(b) distilling off and burning the volatile matter in the dried coke; and
(c) heating and calcining the coke from the step (b).

The present invention will be further described with respect to the following examples with reference to the accompanying drawing.

DETAILED DESCRIPTION

The numerical values set forth hereinafter are only typical ones, and, in particular, the temperature and retention time values indicate standard ranges. Of course, these values can be appropriately varied depending on the properties of green coke and the properties of the calcined coke desired.

Figure 1:
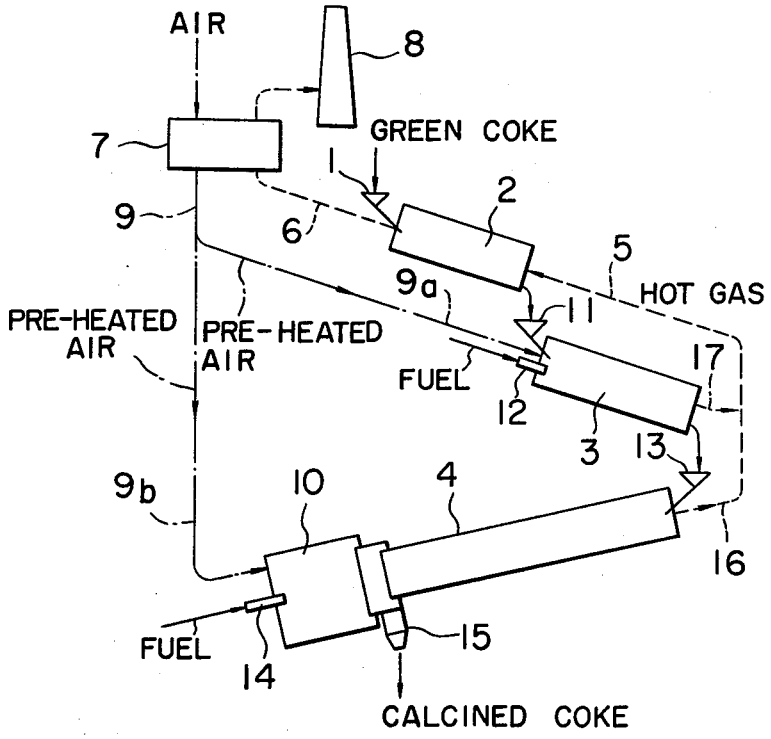
FIG. 1 is a flow chart illustrating one example of the process of the present invention using rotary kilns as heating furnaces.

Referring to FIG. 1, the green coke obtained by a delayed coking process is dressed into the desired particle size distribution, for example, such that about 25% is not greater than 3 mesh, about 75% is above 3 mesh, and the maximum particle diameter is not greater than 70 mm. Then, the coke is introduced into a drying and pre-heating kiln 2 through a raw material feeder 1.

Figure 2:
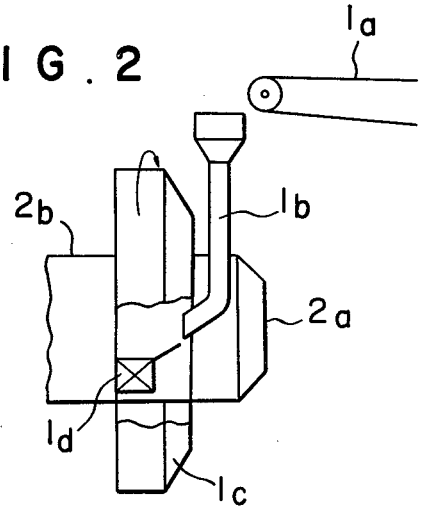
FIG. 2 is a partial side view illustrating an arrangement of a raw material feeder 1 provided in a kiln 2.

The raw material feeder may be of a type wherein a hopper is directly inserted into the kiln 2 from the upper end thereof. In order to ensure a better airtightness, as is shown in FIG. 2, it is preferable that the feeder be of such a type that raw material coke is introduced into an annular raw material reservoir 1*c* having a diameter greater than that of the kiln, which reservoir is attached to the side of the kiln body 2*b* in the neighbourhood of the upper end 2*a* of the kiln, through a conveyor 1*a* and a hopper chute 1*b*, and a trough 1*d* communicating with the kiln body 2*b* is provided, for example, at four portions within the reservoir 1*c*. The raw material is charged into the kiln through the troughs.

The green coke typically has a water content of 7 to 10% (by weight, as in all percentages hereinafter), a volatile matter content of 6 to 10% (according to JIS M 8812), and an apparent density of 0.80 to 0.95 g/cm$^3$. The green coke in the kiln 2 is heated to a temperature of 350° to 400° C. by a hot gas (which is at a temperature between about 1,100° to 1,300° C.), introduced into the kiln 2 through a duct 5 from a burning kiln 3 and a final calcining kiln 4 as hereinafter described. As a result, pre-heating of the coke is carried out with evaporation of the water.

The inclination angle of the kiln 2 is of the order of 1.2 to 3.0 degrees and the inner diameter, the total length, and rotational speed of the kiln are selected so as to ensure a retention time of 10 to 30 minutes. By way of example, an inner diameter of 2.3 m, a total length of 20 m, and a rotational speed of 0.5 to 1.0 rpm are adopted for a green coke charge of 10 tons/hr.

The hot gas leaving the kiln 2 is still at a temperature of about 500° to 700° C., which gas is introduced into an air pre-heater 7 through a duct 6 where the gas undergoes a heat-exchange with air, and the gas itself is cooled to a temperature of about 200° to 400° C. and then discharged outside of the system through a chimney 8, while the air is pre-heated to a temperature of 300° to 500° C. The pre-heated air is introduced into the burning kiln 3 and the combustion chamber 10 of the final calcining kiln 4 through a piping 9 (9*a*, 9*b*). Further, an air inlet (not shown) is provided at the base of the chimney 8 so as to control the quantity of air introduced and to adjust the pressure in the chimney, for example, to −20 mm $H_2O$.

The coke pre-heated to a temperature of 350° to 400° C. in the drying and pre-heating kiln 2 is introduced into the burning kiln 3 through a coke feeding device 11 where the volatile matter contained in the coke is distilled off and burned by the pre-heated air from the piping 9*a*, and the coke is heated to a temperature of about 800° to 980° C.

The coke feeding device 11 is of almost the same type as the raw material feeder 1. Ordinarily, the inlet end of the kiln 3 is positioned immediately below the outlet end of the kiln 2, and the pre-heated coke from the kiln 2 is directly dropped by gravity into an annular material reservoir 11*c* (not shown, corresponding to the reservoir 1*c* of FIG. 2) of the coke feeding device 11 of the kiln 3 through a conduit. If such an arrangement is not appropriate, the transportation between the kilns may be carried out by means of a steel belt conveyor or a moving hopper.

At the start of the operation, the coke bed is heated to a temperature (about 600° C.) at which the volatile matter begins to be distilled off and burned by heat due to a burner 12. After this, the burner 12 may be turned off. The inclination of the kiln 3 is about 1.2° to 3.0°, and the retention time is between 30 to 60 minutes. For a coke charge rate of 10 tons/hr, an example of this kiln 3 has an inner diameter of 3.0 m, a length of 20 m, and a rotational speed of 0.5 to 1.0 rpm.

As stated above, the pre-heated air is introduced into the kiln 3, and an adequate oxidizing atmosphere is maintained within the kiln 3. Accordingly, it is possible to burn the volatile matter completely, whereby high-grade coke is obtained, and, at the same time, saving of fuel is achieved. In addition, as the volatile matter may also be rendered infusible, it is possible to prevent completely the formation of ring-shaped adhesive materials in the drying zone.

In the case where the possibility of coke ring-formation is low, judging from the quantity and properties of the volatile matter contained in green coke or for the convenience of the process operation, the pre-heated air is not always introduced in a parallel flow with the flow direction of the coke as shown in FIG. 1, but it may be introduced in a counter flow. However, in order to maintain a high oxygen concentration in the low-temperature drying zone of the kiln 3 and to promote the infusibilization of the volatile matter and to prevent the formation of coke ring, a parallel flow is preferable.

Then, the coke heated to a temperature of about 800° to 980° C. in the burning kiln 3 is introduced into the final calcining kiln 4 through a coke feeding device 13, where the coke is heated to a calcining temperature of 1,200° to 1,500° C. and thus calcined. The coke feeding device 13 may be of the same type as the coke feeding device 11. The coke is maintained at the calcining temperature for about 10 to 30 minutes in the calcining kiln 4, and the total retention time within the calcining kiln 4 is between about 30 to 60 minutes. In one example of practice, this kiln 4 has an inner diameter of 2.3 m, a length of 20 m, and a rotational speed of 0.5 to 1 rpm for a green coke charge rate of 10 tons/hr.

The calcining kiln 4 may be provided, for example, with the combustion chamber 10 for fuel at the opposite end of the inlet for introducing coke wherein fuel is burned by a burner 14, and the combustion gas is utilized to heat the coke, or an air-premixing type burner which ejects a short flame may be utilized to heat the coke without the burning chamber. Since the quantity of the pre-heated air introduced can be optionally adjusted according to this heating method, it is possible to control the useless combustion of the calcined coke which cannot be avoided in conventional processes, whereby the quality of the calcined coke is improved, and a high yield is obtained.

The burning chamber 10 has a construction in which the discharge opening for the combustion gas is directly connected to the outlet of the kiln. As a short flame burner, use is made of a pre-mixing type gas burner wherein a fuel gas and air for combustion are uniformly mixed, and the mixture is injected through a nozzle for combustion thereof. Particularly, a partial pre-mixing type burner wherein primary air only is mixed with the fuel gas is preferable. By adjusting the quantity of the primary air, it is possible to shorten the flame to a length not greater than 1.0 or 1.5 m.

The calcined coke is removed as a product from a withdrawal chute 15 positioned before the combustion chamber 10. Ordinarily, the withdrawn coke is introduced into a cooler of rotary kiln type which is provided with a spray nozzle for a cooling water therein and water is sprayed directly on the coke. However, if necessary, the coke may be cooled by a gas. According to the present invention, it is possible to control the combustion loss of the calcined coke within 1%.

The flow rate and temperature distribution at the respective parts per 1 ton of green coke are shown in the following table.

| Position No. | Flowing material | Temperature (°C.) | quantity | |
|---|---|---|---|---|
| 1 | Green coke | Ambient temperature | 1 | ton |
| 11 | Pre-heated coke | 400 | 0.92 | " |
| 13 | Volatile matter-free coke | 850 | 0.82 | " |

-continued

| Position No. | Flowing material | Temperature (°C.) | quantity | |
|---|---|---|---|---|
| 15 | Calcined coke | 1,350 | 0.81 | " |
| 9 | Pre-heated air | 360 | 1,330 | $Nm^3$ |
| 9a | Pre-heated air | " | 930 | " |
| 9b | Pre-heated air | " | 400 | " |
| 16 | Combustion gas of fuel | 1,000 | 410 | " |
| 17 | Combustion gas of volatile matter | 1,200 | 1,000 | " |
| 5 | Combustion gas of volatile matter and fuel | 1,140 | 1,410 | " |
| 6 | Combuston gas of volatile matter and fuel | 570 | 1,520 | " |
| 14 | Fuel (calorific value 7,400 kcal/kg) | — | 52 | kg |

The calcined coke thus obtained has the typical properties shown below and is suitable as an electrode material for steel-making and for other applications.

| | |
|---|---|
| Apparent density | 1.42 g/cm$^3$ |
| True specific gravity | 2.110 g/cm$^3$ |
| Coefficient of thermal expansion* (calcined at 1,000° C.) | $1.2\times10^{-6}$/°C. |
| Coefficient of thermal expansion* (graphitized at 2,600° C.) | $0.8\times10^{-6}$/°C. |

*The coefficient of linear thermal expansion was determined as follows.

The calcined coke was pulverized and 92% of the particles having a particle size of above 200 mesh and 8% of the particles having a particle size below 200 mesh were mixed. 100 parts of this mixture was mixed with 25 parts of coal tar binder pitch (of a softening point of 90.3° C., a benzene insoluble content of 19.8%, a quinoline insoluble content of 4.4%, a volatile matter content of 62.7%, and a fixed carbon content of 53.2%), and the mixture was heated, kneaded and mold-shaped. Then, the shaped article was calcined at a temperature of 1,000° C. Another shaped article was graphitized at a temperature of 2,600° C. Test pieces (rods 5 mm in diameter and about 50 mm in length) were made from the calcined article and the graphitized article, respectively. These test pieces were tested over a temperature range of 30° to 100° C.

In the above described example, a rotary kiln was used for each of the three heating furnaces. However, a part or all of these rotary kilns may also be substituted by a rotary hearth, a retort, or a shaft kiln. However, a rotary kiln is preferable for the reasons that the rapid combustion of the volatile matter can be avoided in the volatile matter removing and burning furnace and the final calcining furnace, and a uniform calcination of coke can be carried out under the optimal temperature rising rate, temperature condition, and atmosphere, whereby high-grade calcined coke is obtained.

In addition, it is most preferable to use three heating furnaces from the standpoint of apparatus economy while the independent controllability of the respective furnaces is maintained. However, if necessary, the respective stages or steps can be, of course, further divided into stages or steps in a plurality of furnaces.

As is apparent from the foregoing, the process for calcining coke according to the present invention has the following advantages.

(1) By using three or more heating furnaces, the respective stages of the coke calcination can be controlled independently from each other and the optimum conditions for producing high-grade coke can be realized.

(2) By ensuring complete control of the combustion condition of the volatile matter contained in green coke, it is possible to produce high-grade coke having a high density, and, at the same time, it is possible to eliminate the formation of ring-shaped adhesive materials in the volatile matter evaporating and burning zone, which is encountered in a process for calcining green coke using one rotary kiln. In addition, as the volatile matter can be completely burned, a more efficient recovery of heat can be attained as compared with the prior process.

(3) By suppressing the useless combustion of the calcined coke, it is possible to improve the quality and yield of the coke. The combustion loss of the calcined coke is reduced to about 1% or less, that is, one tenth or below of the entailed in the prior process.

(4) By controlling the different stages of the green coke calcination independently and combining the respective stages, the efficiency of utilization of heat can be improved. When rotary kilns of the same capacity are used, the calcination can be carried out with a converted quantity of fuel used (the quantity of pure fuel used + the quantity of burned coke calculated in terms of the fuel) which is about 30% or less of that required by the prior process.

We claim:

1. A process for calcining green coke containing substantial amounts of water and combustible volatile matter obtained by a delayed coking process in three rotary kilns which are connected in series and wherein the control of the temperature and the adjustment of the atmosphere can be independently carried out, which process comprises carrying out, in the respective kilns in the indicated order, the steps of:

(a) evaporating the water contained in the green coke, and drying and pre-heating the coke to give a final coke temperature in the range of from 350° to 400° C. with off-gases from steps (b) and (c) mentioned hereinbelow, (b) distilling off and burning the volatile matter of the dried coke through a second rotary kiln in an oxidation atmosphere for about 30 to 60 minutes to give a final coke temperature of 800° to 980° C. with air flowing concurrently with the coke, (c) heating and calcining the coke from the step (b) at a temperature of 1,200° to 1,500° C. for 10 to 30 minutes by using as the heating medium a combustion gas obtained by burning fuel at the outlet of the third rotary kiln.

2. A process as claimed in claim 1, wherein the retention time of the first furnace is 10 to 30 minutes.

3. A process as claimed in claim 1, wherein the green coke is heated in the first furnace by a hot gas at a temperature of 1,100° to 1,300° C. having issued from the second and the third furnaces and flowing counter currently with the green coke, and the hot gas is cooled to a temperature of 500° to 700° C.

4. A process as claimed in claim 3, wherein air is indirectly heated by the hot gas from the first furnace to form pre-heated air.

5. A process as claimed in claim 3, wherein the pre-heated air is branched, and one portion thereof is charged into the second furnace together with the pre-heated coke from the first furnace in a parallel flow to use said air for burning the volatile matter contained in the pre-heated coke, the remaining portion of the pre-heated air being used to burn fuel at the outlet end for discharging coke of the third furnace, the resulting combustion gas being used to calcine the coke in the third furnace.

6. A process as claimed in claim 4, wherein at the start of the operation, auxiliary fuel is burned at the inlet end for introducing coke in the second furnace to heat the coke from the first furnace to a temperature at which the volatile matter is burned.

7. A process as claimed in claim 1, wherein said green coke contains 7 to 10% by weight of water and 6 to 10% by weight of volatile matter.

* * * * *